US007115014B2

(12) United States Patent
McGrath et al.

(10) Patent No.: US 7,115,014 B2
(45) Date of Patent: Oct. 3, 2006

(54) ANIMATED TOY FIGURE

(75) Inventors: Tara McGrath, Playa Vista, CA (US); Kevin W. Gray, Thousand Oaks, CA (US); Ok-Soo Choi, Los Angeles, CA (US); Sam Tsui, Shau Kei Wang (CN); Jon Marine, Fullerton, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/933,926

(22) Filed: Sep. 3, 2004

(65) Prior Publication Data

US 2006/0052029 A1 Mar. 9, 2006

(51) Int. Cl.
*A63H 7/00* (2006.01)

(52) U.S. Cl. ..... 446/356; 446/304; 446/483

(58) Field of Classification Search ..... 446/197, 446/198, 267, 298, 301, 304, 305, 330, 337, 446/338, 353, 356, 483
See application file for complete search history.

(56) References Cited

U.S. PATENT DOCUMENTS

| | | | | |
|---|---|---|---|---|
| 2,802,301 | A | 8/1957 | Lohr | |
| 3,163,960 | A * | 1/1965 | Iwaya et al. | 446/272 |
| 3,178,853 | A * | 4/1965 | Greenwood et al. | 446/356 |
| 3,858,352 | A | 1/1975 | Cummings et al. | |
| 3,918,199 | A | 11/1975 | De Masi | |
| 3,959,919 | A | 6/1976 | Baulard-Cogan | |
| 4,151,675 | A | 5/1979 | Juan | |
| 4,164,092 | A * | 8/1979 | Goldfarb et al. | 446/305 |
| 4,185,413 | A * | 1/1980 | Goldfarb et al. | 446/197 |
| 4,192,092 | A | 3/1980 | Goldfarb et al. | |
| 4,224,759 | A | 9/1980 | Saint-Pierre et al. | |
| 4,245,515 | A * | 1/1981 | Iwaya | 74/25 |
| 4,582,499 | A | 4/1986 | Saigo et al. | |
| 4,878,874 | A * | 11/1989 | Terzian | 446/355 |
| 5,112,265 | A | 5/1992 | Naum | |
| 5,141,464 | A | 8/1992 | Stern et al. | |
| 5,167,561 | A | 12/1992 | Rizzo | |
| 5,181,877 | A | 1/1993 | Perkitny | |
| 5,324,225 | A | 6/1994 | Satoh et al. | |
| 5,713,780 | A | 2/1998 | Gallagher | |
| 6,210,249 | B1 | 4/2001 | Stadlbauer | |
| 6,234,862 | B1 * | 5/2001 | Wittenberg | 446/305 |
| 6,273,782 | B1 | 8/2001 | Chan et al. | |

(Continued)

FOREIGN PATENT DOCUMENTS

| | | |
|---|---|---|
| EP | 0630669 A1 | 1/1994 |

*Primary Examiner*—Bena Miller
(74) *Attorney, Agent, or Firm*—James G. O'Neill; Klein O'Neill & Singh, LLP

(57) ABSTRACT

A toy animal having a rigid body with movable legs, head and tail, is operated by internal gear mechanisms powered by a single, reversible, battery-powered motor operated in different directions. A hand controller is attached to the body to actuate the single motor in a selected direction to either move a plurality of legs to cause movement of the body while wagging the animal's tail, and to then cause the toy animal to urinate, or to move the head and actuate a tongue held in the head to lick a person holding the toy animal, or ingest fluid. The toy animal may also include a speaker and related circuitry that is actuated to cause the toy animal to make sounds, such as a bark, panting, a whimper and/or a tinkling sound at appropriate times.

20 Claims, 9 Drawing Sheets

U.S. PATENT DOCUMENTS 6,565,407 B1 * 5/2003 Woolington et al. ..... 446/175
6,695,673 B1 * 2/2004 Stadbauer ..... 446/305
2001/0029146 A1 10/2001 Llorens
2001/0029147 A1 10/2001 Hornsby et al.
2001/0049248 A1 12/2001 Choi

* cited by examiner

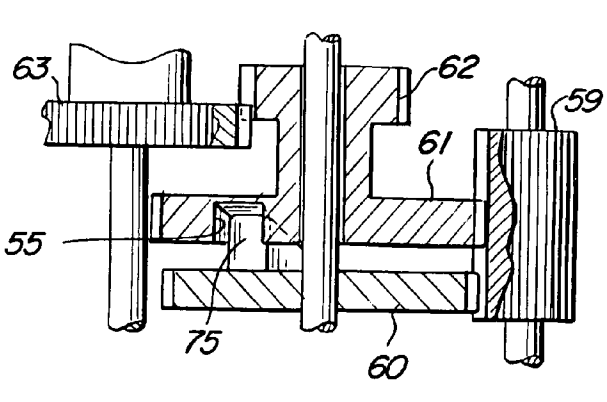
FIG. 6B
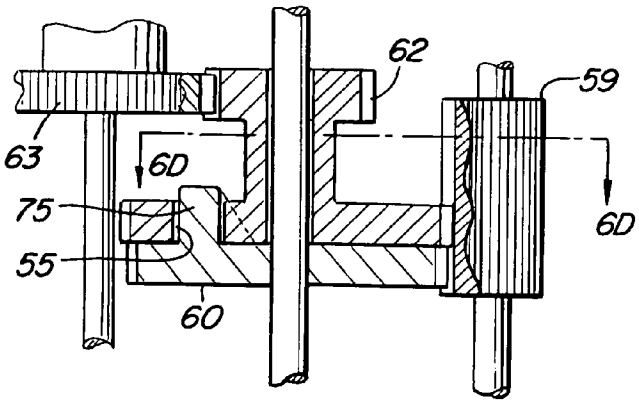
FIG. 6A
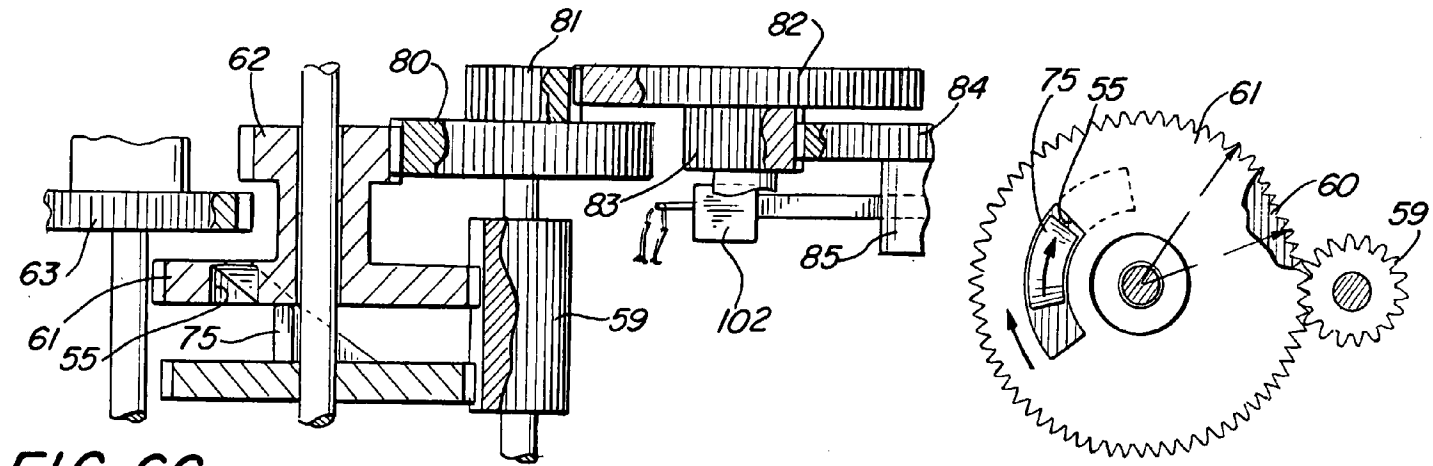
FIG. 6C
FIG. 6D

ANIMATED TOY FIGURE

BACKGROUND OF THE INVENTION

1. Field of the Invention

This invention generally relates to toys, and more particularly, to an animated toy figure, such as a dog, which includes a battery-powered mechanism operated by a remote to allow the animated toy to perform a number of realistic functions, such as make sounds, walk, move its head, drink from a bowl, wag its tail and urinate.

2. Description of the Prior Art

Mechanical animals or dolls that include one or more battery-powered motors for moving the animal or doll, or for moving one or more limbs are well known. Examples of such battery-powered animals or dolls are shown in following listed U.S. Pat. Nos. 4,224,759; 4,582,499; 5,112,265; 5,141,464; 5,181,877; 5,324,225; 5,713,780; 6,210,249; 6,273,782; U.S. 2001/0029147; and U.S. 2001/0049248.

Other mechanical animals or dolls are known that contain various means for simulating drinking or eating by a simulated tongue, bottle or item of food. Examples of such mechanical animals or dolls are shown in following listed U.S. Pat. Nos. 2,802,301; 3,858,352; 3,918,199; 4,192,092; and 5,167,561; as well as European published application number 0 630 669 A1.

Finally, there are a number of mechanical animals or dolls that are known that simulate the ingestion of drink or food and the excretion of milk or waste matter, such as urine. Examples of such mechanical animals or dolls are shown in following listed U.S. Pat. Nos. 3,959,919; 4,151,675; 4,164,092; 4,185,413; U.S. 2001/0029146 A1.

However, none of the known prior art disclose or show a mechanical toy that is actuated by a remote to walk, make sounds, move its head, drink, wag its tail and urinate by means of a gear arrangement or mechanism selectively driven by a single, reversible, battery-powered motor.

Therefore, there exists a need in the art for a mechanical toy animal that performs numerous simulated realistic functions by means of a remote controlled battery-powered motor driven gear arrangement, providing more enhanced play value for a child.

SUMMARY OF THE INVENTION

Accordingly, it is a general object of the present invention to provide an improved mechanical toy. It is a particular object of the present invention to provide an improved mechanical toy animal that moves and urinates. It is a further particular object of the present invention to provide an improved mechanical toy animal that walks, makes sounds, drinks and urinates. It is a yet a further particular object of the present invention to provide an improved mechanical toy dog operable by a remote control to walk, wag its tail, bark, pant, whimper, drink from a bowl, urinate and make a corresponding tinkle sound. And, it is a still further particular object of the present invention to provide an improved mechanical dog with a plush covering that includes a single, reversible, battery-powered motor that is selectively operated by a remote control to actuate a drive arrangement to move a plurality of limbs, wag its tail and to urinate, or to move the dog's head to allow the dog to drink by a moveable tongue, all while making a number of sounds.

These and other objects of the present invention are achieved by providing a simulated toy animal having a rigid body with movable legs, head and tail, operated by an internal gear mechanism powered by a single, reversible, battery-powered motor. A hand controller is attached to the body to actuate the single motor to selectively move a plurality of legs to cause movement of the body while wagging the animal's tail, and to then cause the toy animal to urinate, or to move the head and actuate a tongue held in the head to lick or ingest water. The toy animal may also include a speaker and related circuitry that is actuated to cause the toy animal to make sounds, such as a bark, panting, a whimper and/or a tinkling sound.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

FIGS. 6A–6C are enlarged partial sectional views of a portion of the gear drive mechanism of FIG. 6, showing a pair of gears separable by a cam portion to perform different functions;

FIG. 6D is a cross sectional view, partially broken away, taken along lines 6D—6D of FIG. 6A;

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide for an improved mechanical toy animal, operated by a single battery-powered motor by means of remote, generally indicated at 20.

Figure 1A:
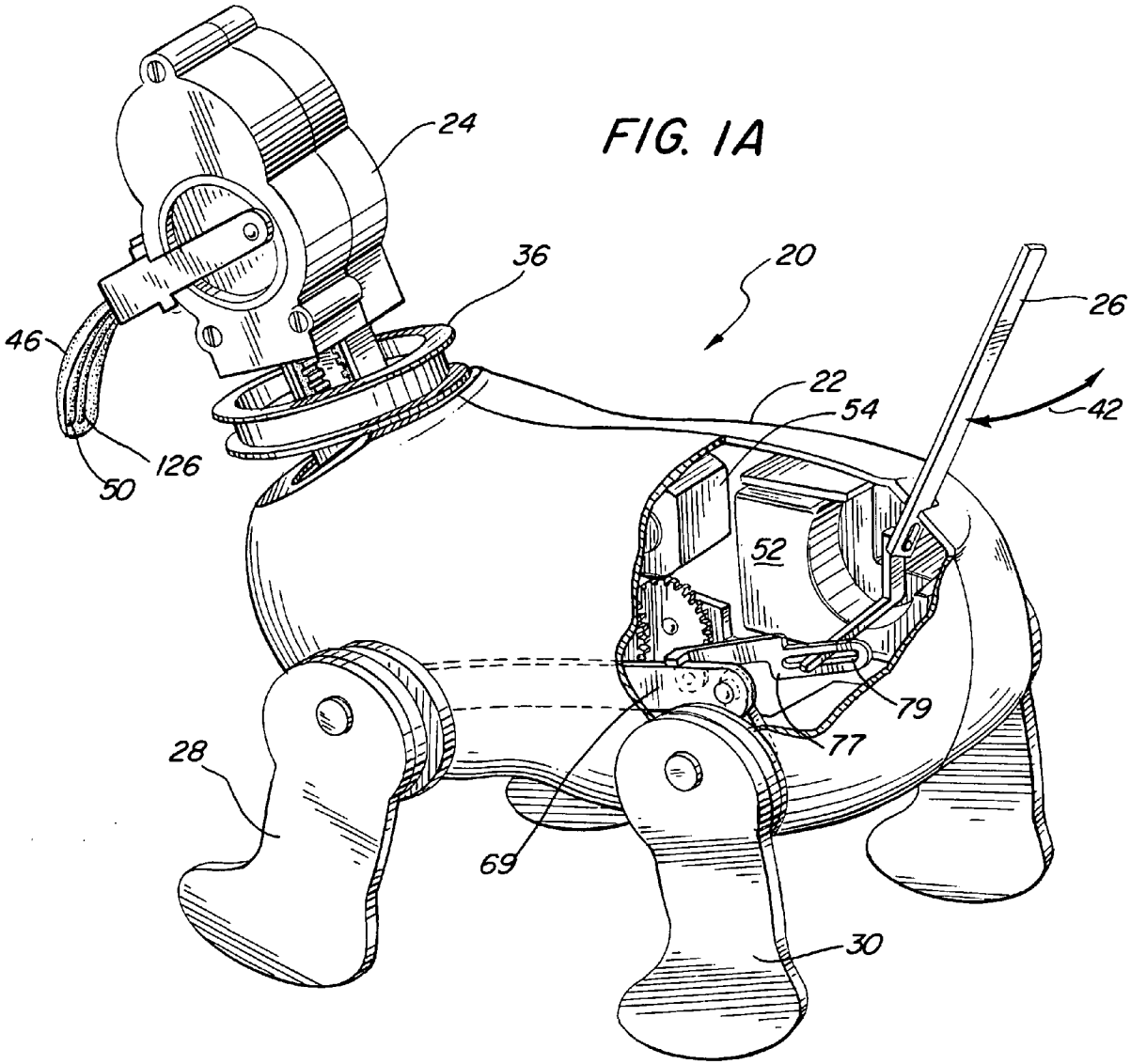
FIG. 1A is an enlarged rear perspective view, partially broken away, showing the rigid body of the toy animal with its plush covering and an external rigid portion of the head removed.

The toy animal 20 is shown in the shape of a dog for purposes of explanation only and not by way of limitation. The toy 20 has a main body portion or housing 22. A head 24 having a mouth 25, a tail 26 and a plurality of legs 27, 28, 29, 30 are movably mounted to the body 22. The body, head, tail and legs of the toy animal 20 are preferably formed from one or more rigid materials, such as a metal or a plastic, covered with a soft material, such as a plush fabric to more closely simulate a dog or other animal. FIG. 1A shows a currently preferred structure of the body 22 with the outer plush fabric cover, as well as an outer shell of the head 24 removed.

A remote controller 32 is connected to the toy animal 20 as by means of a cord, leash or tether 34 secured to the toy animal at a collar or neck portion 36, between the body 22 and head 24. The head 24 may be manually rotated around the neck portion 36, while the remote controller 32 is operatively connected through the neck portion to one or more control chips (not shown), electrical circuitry and a power source, such as a plurality of batteries (not shown). The control chips, electrical circuitry and/or the power source could also be partially or completely held in the controller 32.

The body 22 also preferably includes a speaker 33 (see FIG. 4), held therein and operatively connected to a sound chip or the like and the power source so that the toy animal 20 may emit selected sounds when turned on or off and/or while walking, drinking and/or prior to or during urination. The speaker 33 and the power source may also be controlled by a further on-off button or switch (not shown) in the body 22, for example, in a removable plate or housing also holding batteries at the bottom of the body.

To operate the toy animal 20, the controller 32 is grasped in the hand of a user, such as a child, and a multi-position thumb operated button or switch 38 is activated. When the button or switch 38 is moved from an off or neutral position to a first position, a reversible, battery-powered motor will be activated in a first direction to operate a drive gear arrangement so that the legs 27–30 of the toy animal 20 will be moved to cause the toy animal to simulate walking (see FIG. 1). The legs 27–30 preferably move back and forth, in the direction of the arrows 40. The legs 27–30 may also be moved up and down by eccentrically mounting the legs to the body 22. During movement of the legs 27–30, the motor driven gear arrangement will also move or wag the tail 26 in the direction of the arrow 42. The drive mechanism for operating the legs 27–30 and tail 26 is shown in FIGS. 1, 6, 6A and 10A and explained more fully below. During walking, the toy animal 20 may bark and/or pant, or one or more similar sounds may be heard through the speaker 33, to simulate a happy and/or thirsty animal.

Figure 1:
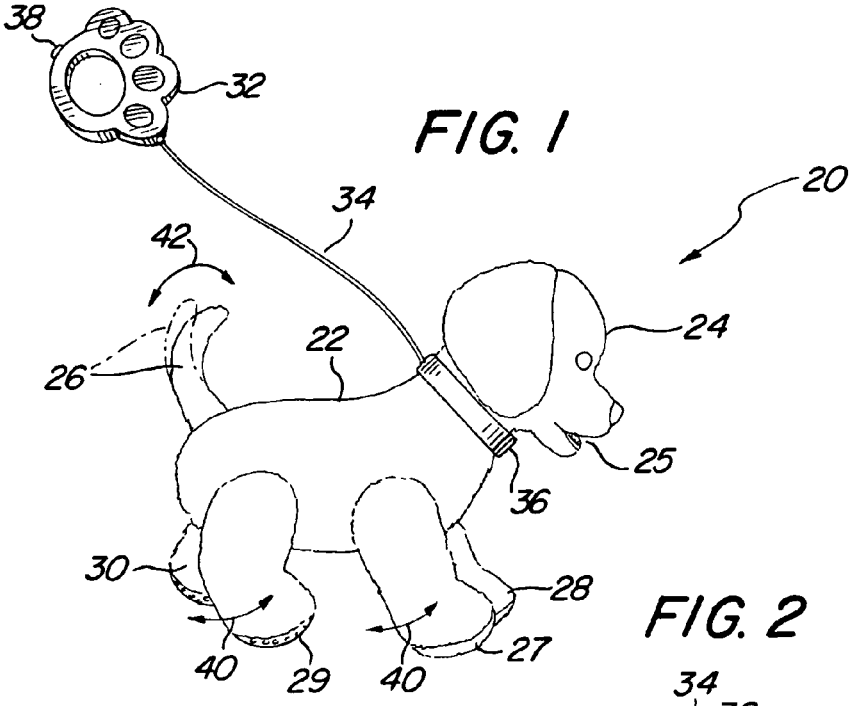
FIG. 1 is a side perspective view of a preferred embodiment of remotely controlled toy animal of the present invention, shown walking and wagging its tail.
Figure 2:
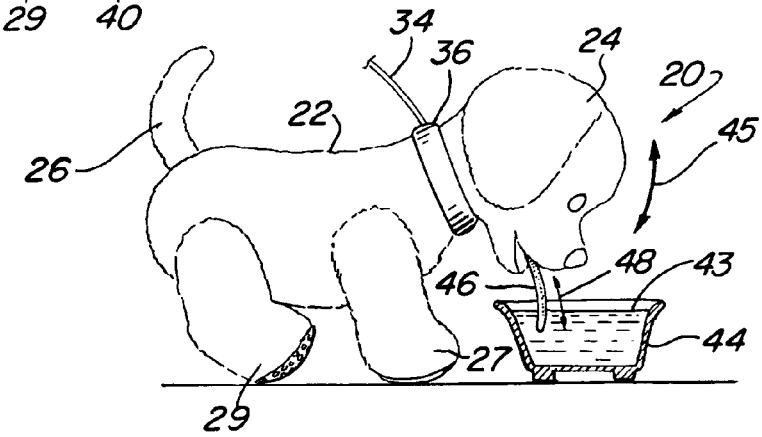
FIG. 2 is a side elevational view of the toy animal of the present invention in a stopped position with its head down and tongue extended while drinking from a bowl.

While walking, upon actuation of the button 38, or after a predetermined period of time, for example, when near a vessel 44, such as bowl having water or another liquid 43 therein, the toy animal 20 may emit a sound and stop or be stopped with its head 24 over the bowl. Or, the bowl 44 may be filled with liquid and moved into place under the head 24 when the animal is stopped. The button or switch 38 is then moved to a second position to activate the reversible, battery-powered motor in a second direction to operate the drive mechanism in the body 22, as shown in FIGS. 4, 8, 10B and 10C, and as explained more fully below. The head 24 is first moved, downwardly, in the direction of arrow 45, and then moves a tongue 46 into and out of the mouth 25, in the direction of the arrow 48. With the head 24 in the lowered position shown in FIG. 2, the drive mechanism is timed to allow the tongue 46 to stay in the water for sufficient lengths of time during its in and out movement to allow a tube 50 in a lower portion of the tongue 46 (see FIGS. 1A, 4 and 8) to suck water 43 into a reservoir 52 held in the body 22 for storage, as explained more fully below. Upon filling of the reservoir 52, or after a further predetermined period of time, the drive mechanism will stop, the animal 20 will stop drinking and the head 24 will be returned to the normal or raised position, in the direction of arrow 45, as by means of spring 53 (see FIG. 10C).

Turning now to FIGS. 6, 6A–6D, 7 and 10A, the operation of the drive mechanism in the first direction for movement of the legs 27–30, tail 26, head 24 and urination by the toy animal 20 will be described. The operation of the legs 27–30 only, by means of an electrical motor and drive mechanism, is similar to that described in U.S. Pat. Nos. 6,210,249 and 6,273,782, the disclosures of which are incorporated herein by this reference thereto. However, it is to be understood that the present invention also utilizes the single electrical motor to wag or move the tail 26, to move the head 24, and to operate the tongue 46 and to fill and empty the reservoir 52.

Figure 6:
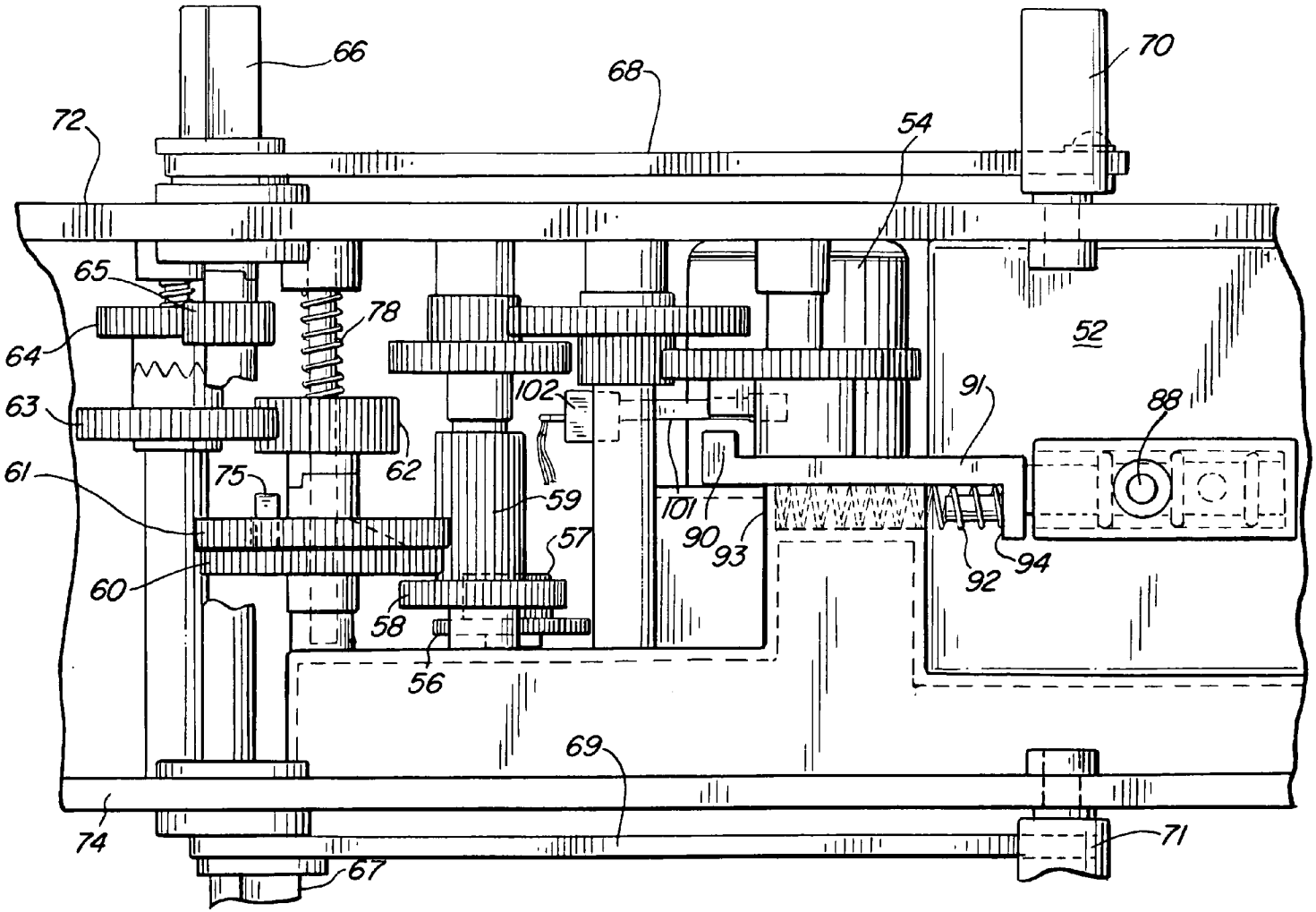
FIG. 6 is an enlarged partial view of a portion of the motor driven internal drive mechanism for operating the walking and urination functions of the toy animal of the present invention.
Figure 7:
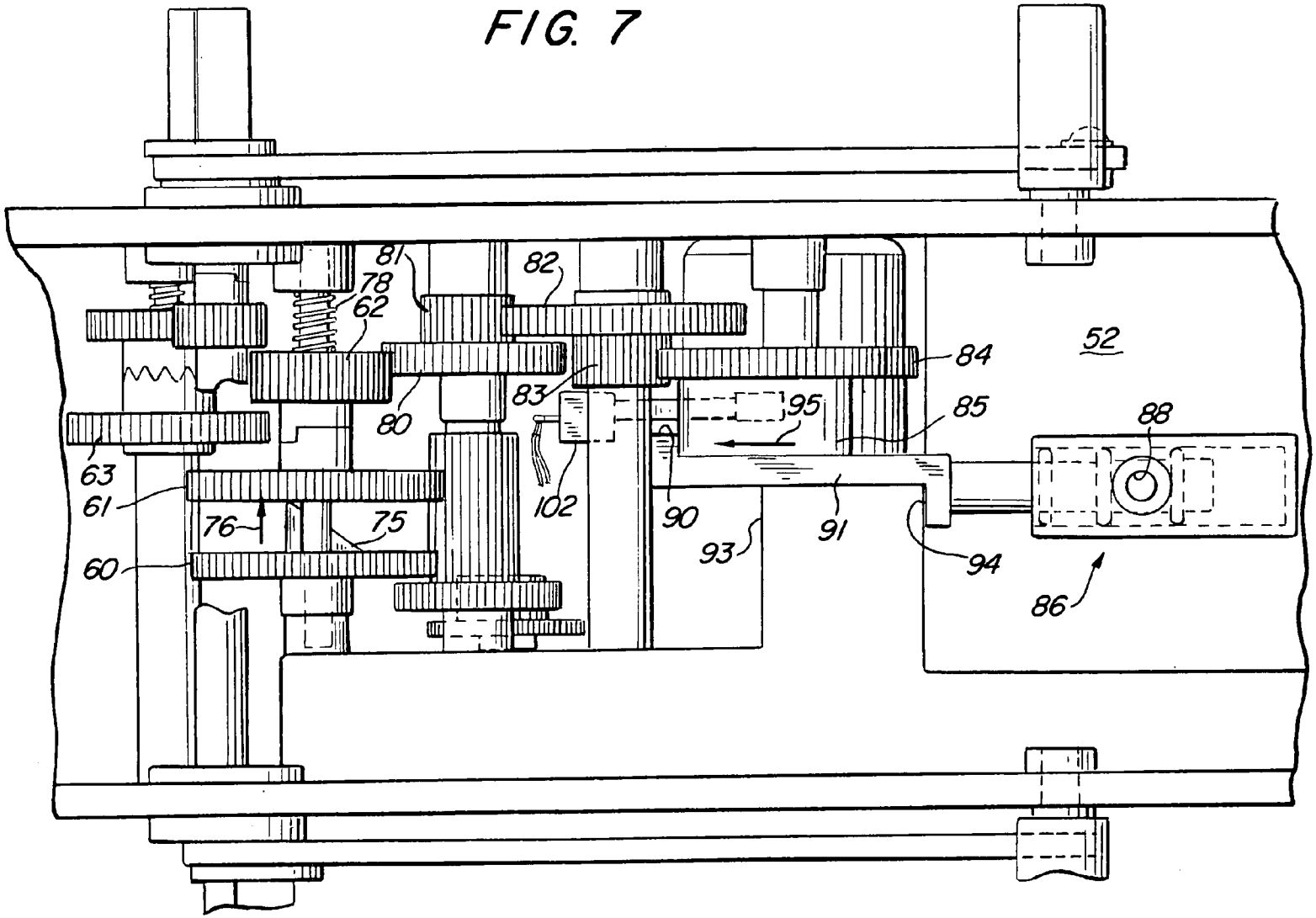
FIG. 7 is a further enlarged partial view of a portion of the internal drive mechanism showing the pair of gears separated by the cam to allow operation of the urination function of the toy animal of the present invention.

In one aspect of the invention, as shown in FIGS. 1A, 6, 6A–6D and 10A the legs 27–30 and tail 26 are moved by a drive gear arrangement by means of a reversible battery-powered motor 54, when the reversible battery-powered motor is activated in a first or forward direction by the button 38. The motor 54 is coupled to a driving gear or pulley system connected to a clutch, such as a swing gear clutch (see 103 in FIGS. 10A–10C), to operate a plurality of gears, such as 56–65 to rotate front leg connectors 66, 67 and the front legs 27, 28 (see FIGS. 1–3), attached to the front leg connectors. As shown in FIG. 6, when front legs 27, 29 are operated through the gears 56–65 and connectors 66, 67 they also move a pair of links 68, 69 to rotate rear leg connectors 70, 71 to move rear legs 29, 30, attached to the rear leg connectors. Additionally, as best shown in FIG. 1A, the link 69 is connected to an arm 77, having a slot 79 formed therein. The slot 79 holds an L-shaped element 87, connected to the base of the tail 26 so as to move the tail in the direction of the arrow 42 (FIGS. 1 and 1A) when the link 69 is moved.

The leg connectors 66, 67, 70 and 71 may be eccentrically mounted on the body 22, while the number of clutches and gears used and their exact alignment, arrangement and size will depend on the size of the toy animal 20, the motor 54 and the speed at which it is desired to operate the various elements of the toy animal 20. The major constraints will be the size of the body 22 and the strength of the motor 54. All of the gears 56–65 are mounted on a plurality of shafts held in the body 22 and extending between internal rigid walls 72, 74, or internal portions secured to the walls.

As shown in FIGS. 6A–6D, 7, 10A and 10C, after the reservoir 52 is filed and the toy animal 20 operated in the first or forward direction by the remote 32 so that it has moved or walked for a predetermined amount of time by the legs 27–30, the speaker 33 will emit a sound such as a bark or whimper to advise the user that the toy animal wishes to stop and urinate. This allows the user time to place a simulated newspaper or the like 73 under the rear of the stopped toy animal 20 (see FIG. 3). Although the legs 27–30 of animal will have stopped moving, the motor 54 will continue operating in the first direction. A cam 75 held in an upper surface of gear 60 and extending through an opening formed in the companion or coupled gear 61 is slowly moved to separate the gears 60 and 61, in the direction of arrow 76, against the bias of a spring 78 acting against gear 62, preferably integrally formed with or connected to gear 61. The gears 60 and 61 are preferably of different diameter, and/or have a different number of teeth to allow them to spin at different rates whereby they are together for a predetermined time before they are cammed apart by the displacement of the cam 75. Movement of the gear 61 in the direction of the arrow 76 will move gear 62 out of engagement with gear 63 (driving the legs) and into engagement with a gear 80 to open valve means to simulate urination.

Figure 3:
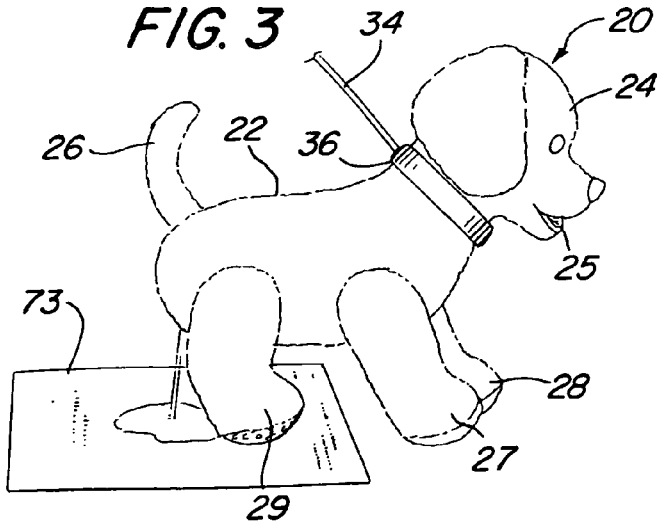
FIG. 3 is a still further side elevational view of the toy animal of the present invention in a second stopped position with the animal over a simulated newspaper or the like while urinating.
Figure 4:
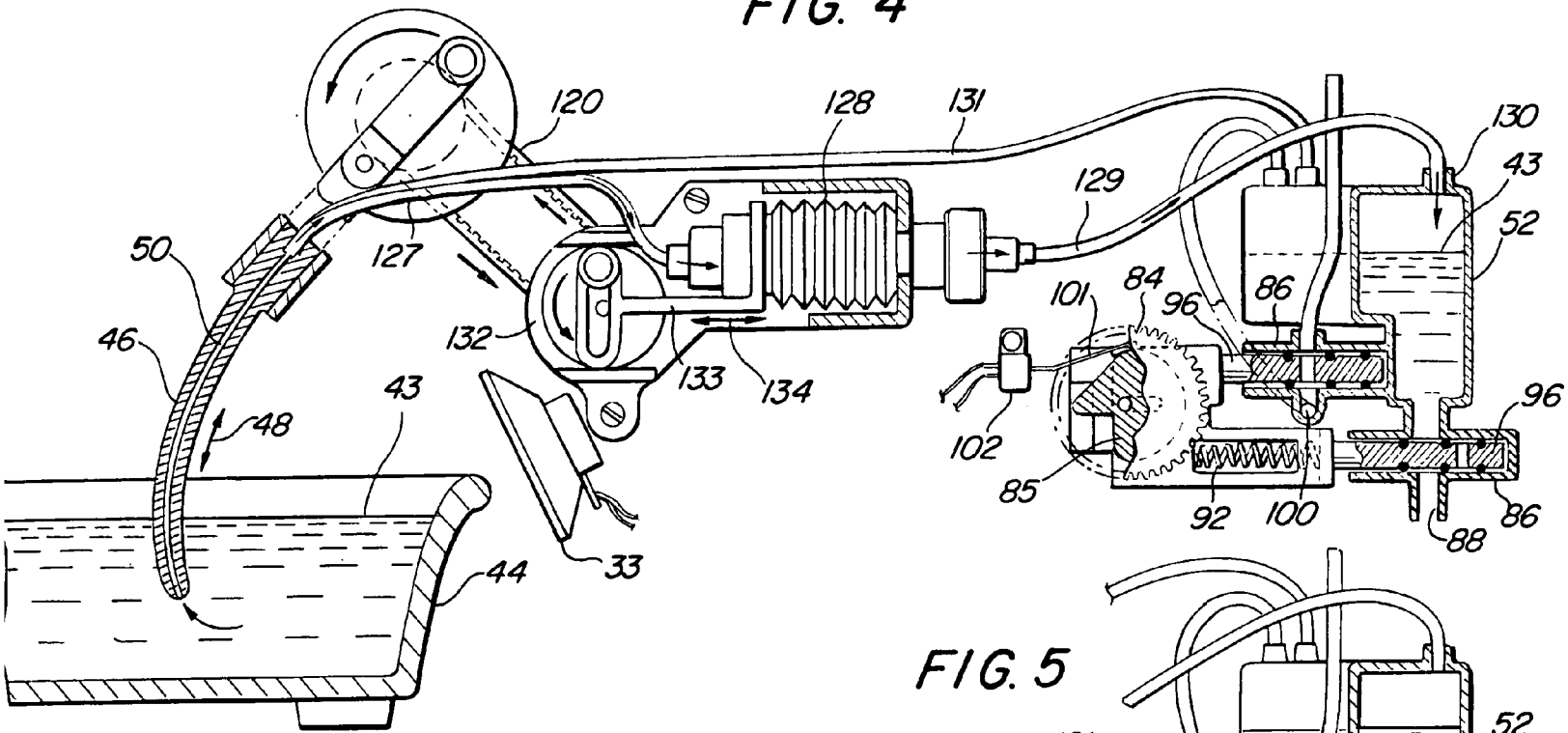
FIG. 4 is an enlarged schematic view, partially in cross section, of a tongue and water storage/elimination system of the toy animal of the present invention, showing movement of the tongue and how it allows liquid to be drawn into a reservoir in the animal's body.
Figure 5:
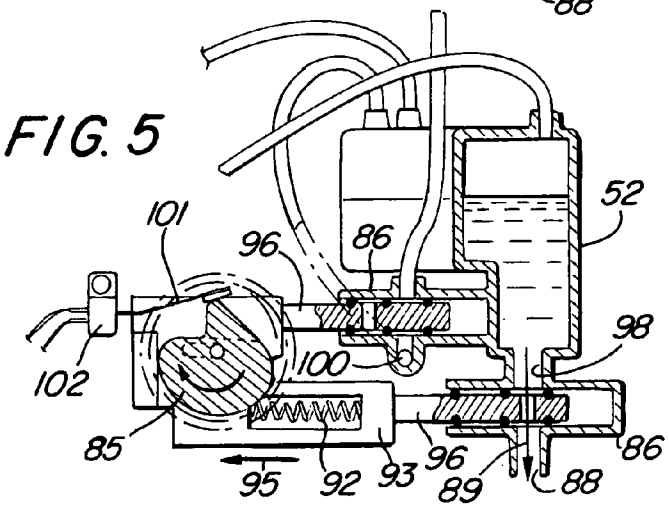
FIG. 5 is a further enlarged schematic view, partially in cross section, of the water storage/elimination system of FIG. 4, showing operation of control valves to allow liquid to be emptied from the reservoir in the animal's body, to simulate urination.

Gear 80 is connected to gear 81 which drives gears 82 and 83 so as to rotate gear 84. Therefore, the continued rotation of separated gears 60 and 61, and attached gear 62, will rotate gears 80–84. The rotation of gear 84 causes a partial cam element 85, secured to the base of gear 84, to operate one or more valve means 86, such as slide valves, in the base of the reservoir 52 to allow the reservoir to be emptied through an opening 88 (see arrow 89 in FIG. 5). Depending on how many slide valves 86 are used, and how they are arranged, the partial cam element 85 either presses against or relieves pressure against raised ends 90 of slidable arms or links 91. For example, see FIGS. 4 and 5 for one such arrangement. The arms 91 will be moved by or against springs 92 mounted in housings 93 and acting against lower portions or walls 94 of the arms 91 to move the arms, for example, in the direction of arrow 95 (see FIGS. 5 and 7), to move control portions 96 of the slide valves 86, having openings formed therein, to open or close the valves, for example open a port 98 in the reservoir 52, to allow fluid in the reservoir to flow, thus simulating the act of urination (FIGS. 3–5). At the same time a second slide portion 96 may close an exhaust or vent opening 100.

The rotating cam element 85 may be in contact with an arm 101 of a limit switch 102 to control the time of emptying of the reservoir 52. During emptying of the reservoir 52 the toy animal 20 will remain in place over the newspaper 73 and may emit a sound, such as whimpering. After a predetermined or random period of time, the gears 60 and 61 will again be turned to move cam 75 so as to allow the gears 60 and 61 to be brought together again, by the spring 78, thus moving the gear 62 back into engagement with gear 63. The toy animal 20 will, therefore, commence walking until a predetermined time passes or the controller 32 is actuated to stop motion and/or refill the reservoir 52.

Figure 8:
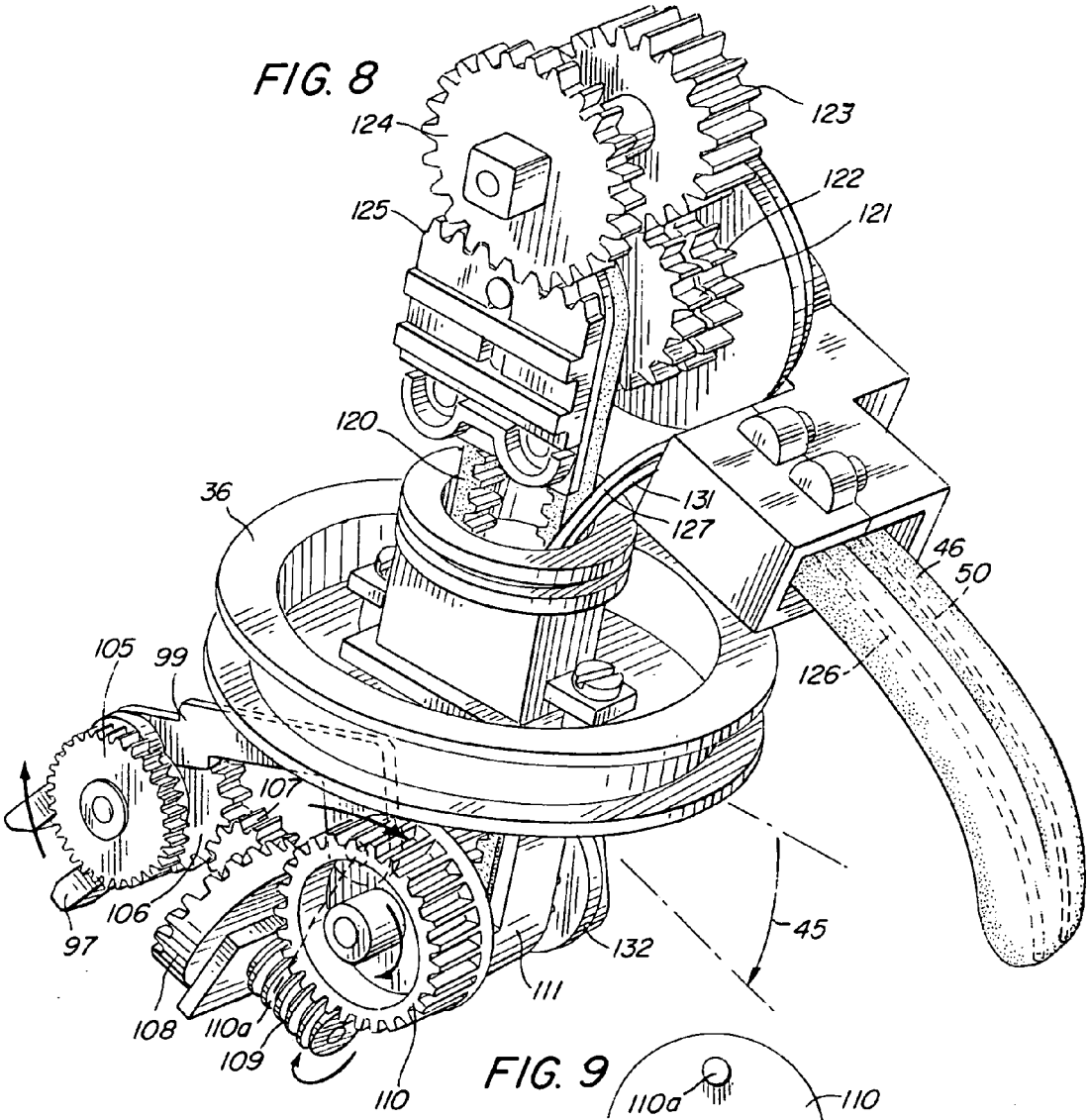
FIGS. 8 and 10A–10C show enlarged partial views of the motor driven internal drive mechanism, in various configurations, of the toy animal of the present invention.
Figure 9:
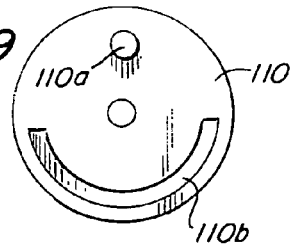
FIG. 9 is a rear elevational view of one of the gears for movement of the head.
Figure 10A:
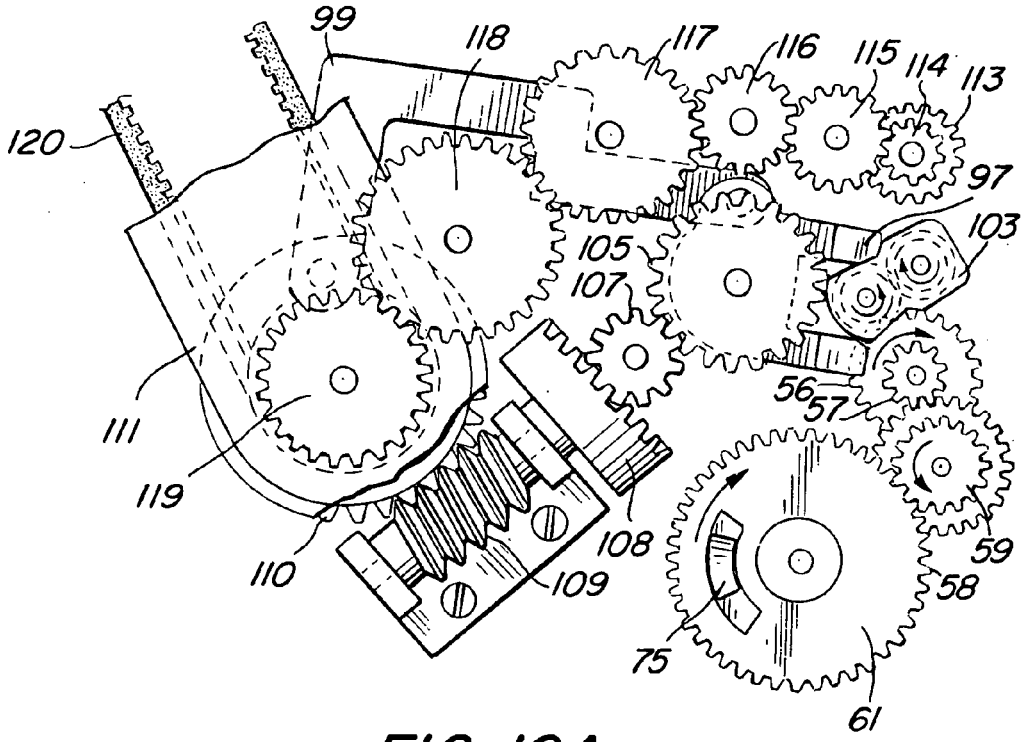
Figure 10B:
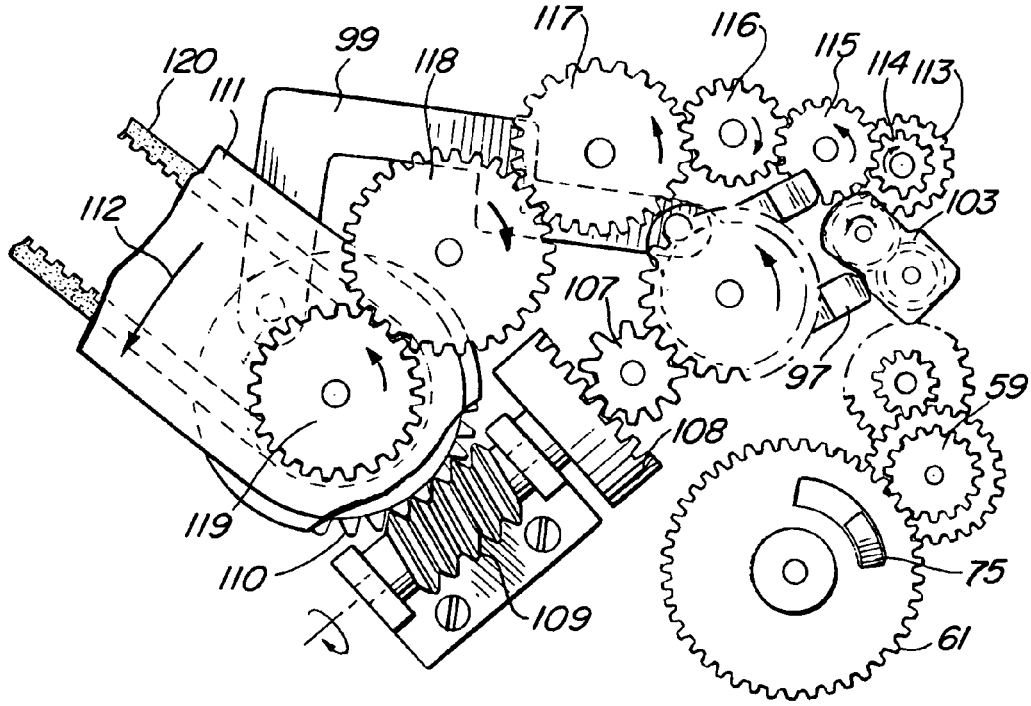
Figure 10C:
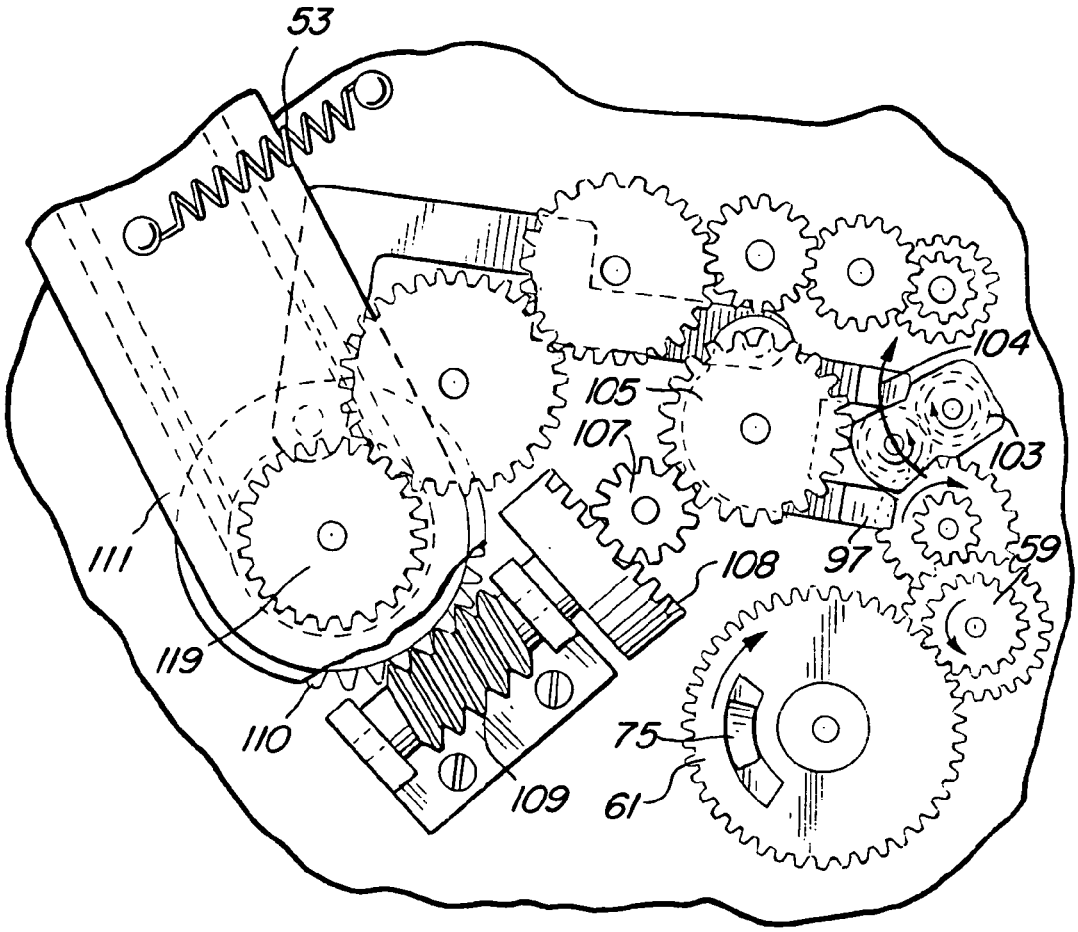

Turning now to FIGS. 4, 5, 8 and 10A–10C, the operation of the head 24 and reservoir filling system and its cooperation with the emptying or urination system of the present invention will now be explained. When the toy animal 20 is stopped with its head 24 over the bowl 44 having the liquid 43 therein, the button or switch 38 on the remote 32 is moved in a second or reverse direction to operate the motor 54 in the reverse direction. The motor 54 will then operate a further set of gears in the gear drive or train. As shown in FIGS. 10A and 10C, and explained above, when swing clutch or gear 103 is in a lowered or first position and the motor 54 is operating in the first direction the legs 27–30, the tail 26 and eventually one or more slide valves 86 will be operated. However, when the motor 54 is reversed it operates gear 103 to drive a further set of gears or gear train, as shown in FIGS. 8 and 10B. That is, gear 103 operates gears 105 and 106 to turn a gear 107, which rotates a crown gear 108 so as to turn a worm gear 109 to drive a gear 110 and rotate a housing 111, in the direction of arrow 45 in FIG. 8, or arrow 112 in FIG. 10B. The reverse side of gear 110 is shown in FIG. 9 as having a pin 110*a* and a slot 110*b* formed thereon, to both limit the downward rotation of the gear 110 and, therefore, the housing 111, as well as move a link 99 secured at one end to pin 110*a*. The rotation of the housing 111 rotates the head 24 downwardly, in the direction of the arrow 45 shown in FIGS. 2 and 8, while the movement of the pin 110*a* and link 99 moves or rotates a U-shaped element 97 to move the gear 103, in the direction of the arrow 104 shown in FIG. 10C, to the position shown in FIG. 10B.

When the head 24 reaches its lowered position and the U-shaped element 97 rotates 103, the gear drive will be switched to operate the tongue 46. As best shown in FIGS. 10A and 10B, the motor 54, still being driven in the reverse or second direction, will operate the gear train to move the tongue 46 in and out of the mouth 25. That is, after the 24 head is in the lowered position show in the drawings and the swing gear 103 moved in the direction of arrow 104 to the position shown in FIG. 10B, the swing gear 103 drives a series of gears 113, 114, 115, 116, 117, 118 and 119. This series of gears thereby drives a gear or pulley rotatably mounted on a shaft held in the housing 111 so as to move an endless belt 120. The series of gears 113–119 also drive a crank 132 secured to the shaft on the other side of the housing 111 to operate a pump, as described below. The endless belt 120 drives a gear or pulley secured in the upper end of the housing 111 to drive a series of gears 121, 122, 123, 124 in the head to move a rack 125 so as to move the tongue 46 in and out, in the direction of arrow 48 (see FIGS. 2 and 4).

As is best shown in FIGS. 4 and 8 the tongue 46 has two tubes 50 and 126 formed in a lower portion thereof. When the tongue is immersed in a liquid 43, such as water, the tube 50 will suck or pump water from the bowl 44 to the reservoir 52. The tube 50 is attached to a further tube 127 that is attached to the inlet of a pump 128, such as bellows. The pump 128 has a one-way check valve at the inlet end and a one-way valve at the outlet end to control the flow of fluid through the pump. The outlet end of the pump 128 is connected to a further tube 129 connected to an inlet 130 in the reservoir 52. An outlet tube 131 is connected between the top of the reservoir 52 and tube 126.

The pump 128 is driven by the crank 132 when the gear train 113–119 is operating, by means of an arm or lever 133 secured to the pump and which operates the bellows in the direction of the arrow 134 to pull water from the bowl 44 and push it into the reservoir 52. Once the pump stops operating for any reason, for example, if the motor 54 is stopped, the head 24 will be returned to its upright position by the spring 53 and the swing gear 103, link 99 and U-shaped element 97 will return to their rest position shown in FIGS. 8, 10A and 10C. The toy 20 may then be operated in the first or forward direction to walk, etc.

There has thus been described a novel and unique animated toy, in the form of a dog, which is driven by a single reversible motor to simulate drinking, walking, wagging of a tail and urinatation by the action of a remote control tether easily manipulated by a child during play. The animated toy preferably includes a speaker that emits sounds coordinated to the simulated actions of the toy animal, such as barking, whimpering and tinkling.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than as specifically described herein.

What is claimed is:

1. An animated toy animal, comprising:

a rigid body comprised of a plurality of movable legs, a movable head and a movable tail;

a reversible motor held in the rigid body and connected to a gear drive arrangement for selective movement of the plurality of movable legs, the movable head and the movable tail; and a reservoir held in the rigid body and fluidly connected to a movable tongue in the head, whereby upon actuation of the movable head by the reversible motor the reservoir may be filled with a liquid upon placement of the movable tongue in the liquid.

2. The animated toy animal of claim 1, further including a valve held in the body and connected to the reservoir whereby upon operation of the valve by the reversible motor the toy animal will open the reservoir to simulate urination.

3. The animated toy animal of claim 2 wherein the gear drive arrangement is selectively operated by actuation of the reversible motor in one of two directions.

4. The animated toy animal of claim 3 wherein when the reversible motor is actuated in a first direction the plurality of movable legs will be moved so as to simulate walking and the tail will be moved to simulate wagging.

5. The animated toy animal of claim 4 wherein the animated toy animal includes a gear drive connection to stop movement of the plurality of movable legs and movement of the tail and to open the valve, a predetermined amount of time after the actuation of the reversible motor in the first direction.

6. The animated toy animal of claim 5 wherein when the reversible motor is actuated in a second direction the movable head will be moved downwardly, toward a bowl containing the liquid so as to ingest the liquid.

7. The animated toy animal of claim 6 wherein the movable tongue includes at least one tube for taking the liquid from the bowl and moving it to the reservoir.

8. The animated toy animal of claim 7, further including a pump held in the housing and fluidly connected between the at least one tube in the movable tongue and the reservoir to move the liquid between the movable tongue and the reservoir upon actuation of the pump by the gear drive arrangement.

9. The animated toy animal of claim 8, further including a second tube in the movable tongue fluidly connected to the reservoir to drain any overflow of liquid from the reservoir.

10. The animated toy animal of claim 9 wherein the reversible motor is operated by a remote.

11. The animated toy animal of claim 1 wherein the gear drive arrangement is selectively operated by actuation of the reversible motor in one of two directions.

12. The animated toy animal of claim 11 wherein when the reversible motor is actuated in a first direction the gear drive arrangement will move the plurality of movable legs to simulate walking and the tail will be moved to simulate wagging, and wherein the gear drive arrangement includes a connection operable after a predetermined period of time to stop movement of the plurality of movable legs and movement of the tail and to open a valve in the body to open a port in the reservoir to simulate urination.

13. The animated toy animal of claim 12 wherein when the reversible motor is actuated in a second direction the gear drive arrangement will move the head downwardly, toward a bowl, so as to insert the movable tongue into the liquid whereby a tube in the movable tongue takes the liquid from the bowl and moves the liquid to the reservoir.

14. The animated toy animal of claim 11, further including a pump held in the housing and connected between the tube in the movable tongue and the reservoir to move the liquid between the movable tongue and the reservoir upon actuation of the pump by the gear drive arrangement; and a second tube held in the movable tongue and connected to the reservoir to allow drainage of any overflow of liquid from the reservoir.

15. The animated toy animal of claim 14 wherein the reversible motor is operated by a remote.

16. An animated toy animal, comprising:

a rigid body comprised of a plurality of movable legs, a movable head and a movable tail;

a reversible motor held in the rigid body and connected to a gear drive arrangement for selective movement of the plurality of movable legs, the movable head and the movable tail;

a reservoir held in the rigid body and fluidly connected to a movable tongue in the head, whereby upon actuation of the movable head by the gear drive arrangement the reservoir may be filled by placement of the movable tongue in a liquid;

a valve held in the body and connected to an outlet port in the reservoir whereby upon operation of the valve by the reversible motor the outlet port will be open to allow the liquid to flow from the reservoir to simulate urination;

the gear drive arrangement being selectively operated by actuation of the reversible motor in one of two directions, including a first direction whereby the plurality of movable legs will be moved so as to simulate walking and the tail will be moved to simulate wagging.

17. The animated toy animal of claim 16 wherein the gear drive arrangement includes a gear drive connection, operable a predetermined amount of time after the actuation of the reversible motor in the first direction, to stop movement of the plurality of movable legs and the tail and to open the valve.

18. The animated toy animal of claim 15 wherein when the reversible motor is actuated in a second direction the movable head will first be moved downwardly, toward a bowl and to then ingest the liquid contained in the bowl by a first tube in the movable tongue and to move the liquid from the first tube to the reservoir upon actuation of the pump by the gear drive arrangement; and a second tube held in the movable tongue and connected to the reservoir to allow drainage of any overflow of liquid from the reservoir.

19. An animated toy animal, comprising:

a rigid body comprised of a plurality of movable legs, a movable head and a movable tail;

a plush fabric covering the plurality of movable legs, the movable head and the movable tail;

a reversible motor held in the rigid body and connected to a gear drive arrangement for selective movement of the plurality of movable legs, the movable head, the movable tail, at least one valve, the head and a movable tongue in the head;

a reservoir held in the rigid body and fluidly connected to the movable tongue, whereby upon actuation of the movable head the reservoir may be filled by placement of the movable tongue in a liquid;

the at least one valve being a slide valve held on the reservoir and connected to an outlet port, whereby upon operation of the slide valve by the reversible motor the outlet port will be opened to simulate urination;

the gear drive arrangement being selectively operated by actuation of the reversible motor in a first direction to move the plurality of movable legs to simulate walking and move the tail to simulate wagging; and a second direction to first move the movable head downwardly, toward a bowl and to then ingest a liquid contained in the bowl by actuation of a pump held in the rigid body and connected between the a first tube in the movable tongue and the reservoir to move the liquid between the first tube and the reservoir upon actuation of the pump by the gear drive arrangement; and a second tube in the movable tongue and connected to an upper surface of the reservoir to allow drainage of any overflow of fluid from the reservoir.

20. The animated toy animal of claim 19 wherein the reversible motor is operated by a remote and the pump is a bellows.

* * * * *